US008337375B2

(12) United States Patent
Lee et al.

(10) Patent No.: US 8,337,375 B2
(45) Date of Patent: Dec. 25, 2012

(54) APPARATUS AND METHOD FOR MAKING TUBE WITH POLYGONAL CROSS-SECTION

(75) Inventors: Jae-Mun Lee, Seongnam-si (KR); Han-Yong Cho, Yongin-si (KR)

(73) Assignee: Dyne Technology Co., Ltd. (KR)

( * ) Notice: Subject to any disclaimer, the term of this patent is extended or adjusted under 35 U.S.C. 154(b) by 0 days.

(21) Appl. No.: 13/335,765

(22) Filed: Dec. 22, 2011

(65) Prior Publication Data

US 2012/0090771 A1 Apr. 19, 2012

Related U.S. Application Data

(63) Continuation of application No. 11/937,927, filed on Nov. 9, 2007, now abandoned, which is a continuation of application No. PCT/KR2006/001664, filed on May 3, 2006.

(30) Foreign Application Priority Data

May 12, 2005 (KR) ..... 10-2005-0039872

(51) Int. Cl.
*B31C 1/08* (2006.01)
*B31C 11/02* (2006.01)

(52) U.S. Cl. ..... 493/301; 493/276; 493/288; 493/964

(58) Field of Classification Search ..... 493/269, 493/273, 276, 287, 288, 289, 299, 300, 301, 493/302, 303, 304, 305, 306, 964
See application file for complete search history.

(56) References Cited

U.S. PATENT DOCUMENTS 663,438 A 12/1900 Hinde
726,894 A 5/1903 Ferres
1,319,455 A 10/1919 Bartlett
2,016,273 A 10/1935 Atwood (Continued)

FOREIGN PATENT DOCUMENTS

AU 34377 71 4/1973

(Continued)

OTHER PUBLICATIONS

International Search Report dated Aug. 16, 2006 in PCT Application PCT/KR2006/001664, which is the parent application of this application.

(Continued)

*Primary Examiner* — Paul R Durand
(74) *Attorney, Agent, or Firm* — Knobbe Martens Olson & Bear, LLP.

(57) ABSTRACT

An apparatus for manufacturing a paper tube having a polygonal cross section includes a frame, an elongate core assembly having an end rotatably supported to the frame and the other free end and having an outer peripheral surface of a predetermined polygonal shape, and a delivery member installed to the core assembly for at least a portion of the delivery member to be exposed from the outer peripheral surface of the core assembly on which the strips are wound, the delivery member being installed for the exposed portion to move toward the free end of the core assembly after receiving the power, whereby the exposed portion contacts with an inner surface of the lowermost one of a plurality of the strips and thus a plurality of the strips wound on the core assembly continuously move toward the free end of the core assembly.

20 Claims, 12 Drawing Sheets

U.S. PATENT DOCUMENTS 2,709,400 A * 5/1955 Bugg ..... 493/301
2,738,153 A 3/1956 Frase
2,777,501 A 1/1957 Fischer
2,788,840 A 4/1957 Mauk et al.
2,877,150 A 3/1959 Wilson
2,893,296 A 7/1959 Yovanovich
2,955,791 A 10/1960 Walter
3,068,934 A 12/1962 Mauk et al.
3,216,457 A 11/1965 Zavasnik
3,383,025 A 5/1968 Ferrey et al.
3,410,473 A 11/1968 Petrie
3,538,817 A 11/1970 Brown
3,623,929 A * 11/1971 Wannamaker ..... 156/190
3,697,029 A 10/1972 Lauffer
3,732,790 A 5/1973 Miyake et al.
3,838,632 A 10/1974 Miyake
3,910,171 A * 10/1975 Reinhardt et al. ..... 493/442
3,960,624 A * 6/1976 Erlandson ..... 156/69
3,966,646 A 6/1976 Noakes et al.
4,120,323 A 10/1978 Saul
4,123,312 A * 10/1978 Schmid et al. ..... 156/466
4,260,446 A 4/1981 Saul
4,263,076 A * 4/1981 Saul ..... 156/194
4,441,948 A 4/1984 Gillard et al.
4,473,368 A * 9/1984 Meyer ..... 493/34
4,563,377 A 1/1986 Melli
4,831,938 A 5/1989 Atterby et al.
4,917,660 A * 4/1990 Spaller et al. ..... 493/42
4,952,202 A * 8/1990 Itoh ..... 493/299
5,106,356 A * 4/1992 Rhodes et al. ..... 493/8
5,425,693 A 6/1995 Gardner et al.
5,468,207 A * 11/1995 Bower et al. ..... 493/297
5,495,810 A 3/1996 Yoshii
5,547,451 A * 8/1996 Drummond et al. ..... 493/299
D395,534 S 6/1998 Besaw
5,797,832 A 8/1998 Ong et al.
5,873,806 A * 2/1999 Biagiotti ..... 493/290
5,944,252 A 8/1999 Connelly et al.
6,027,439 A * 2/2000 Busse et al. ..... 493/288
6,033,352 A * 3/2000 Howard et al. ..... 493/299
6,106,451 A * 8/2000 Andreasson ..... 493/300
6,558,777 B2 5/2003 Yoshii
6,656,104 B1 * 12/2003 Forrester et al. ..... 493/459
6,899,039 B2 5/2005 Perazzo
2004/0096604 A1 5/2004 van de Camp
2006/0280883 A1 12/2006 van de Camp

FOREIGN PATENT DOCUMENTS

DE 19654119 A1 6/1998
JP 50-91808 A 7/1975
KR 10-2002-0038467 A 5/2002
KR 10-2006-0117201 11/2006
WO WO 97/13695 A1 4/1997

OTHER PUBLICATIONS

Supplementary European Search Report in counterpart European Application No. 06757624—1 page, Dated Apr. 20, 2010.

Written Opinion dated Aug. 16, 2006 in PCT Application PCT/KR2006/001664, which is the parent application of this application.

* cited by examiner

APPARATUS AND METHOD FOR MAKING TUBE WITH POLYGONAL CROSS-SECTION

CROSS-REFERENCE TO RELATED PATENT APPLICATIONS

This application is a continuation application of U.S. patent application Ser. No. 11/937,927, filed Nov. 9, 2007, which is a continuation application under 35 U.S.C. §365(c) of International Application No. PCT/KR2006/001664, filed May 3, 2006 designating the United States. International Application No. PCT/KR2006/001664 was published in English as W02006/121253 A1 on Nov. 16, 2006. This application further claims the benefit of the earlier filing date under 35 U.S.C. §365(b) of Korean Patent Application No. 10-2005-0039872 filed May 12, 2005. This application incorporates herein by reference U.S. patent application Ser. No. 11/937,927, International Application No. PCT/KR2006/001664 including International Publication No. W02006/121253 A1 and Korean Patent Application No. 10-2005-0039872 in their entirety.

BACKGROUND

1. Field

The present disclosure relates to paper tubes, and more particularly, to paper tubes with a corrugated paper layer, method of making of paper tubes, machines for making paper tubes.

2. Discussion of the Related Technology

References which disclose paper tubes are as follows: International Publication No. WO 97/13695, published on Apr. 17, 1997, entitled "METHOD AND DEVICE FOR PRODUCTION OF TUBES"; Korean Patent Laid-Open Publication No. 10-2002-0038467, published on May 23, 2002, entitled "POLYGONALLY WRAPPED PAPER PIPE MAKING MACHINE"; U.S. Pat. No. 4,120,323, issued on Oct. 17, 1978, entitled "POLYGONALLY WRAPPED SLEEVE AND METHODS AND DEVICES FOR MAKING SAME"; Japanese Patent Laid-Open Publication No. (Sho) 50-91808, published on Jul. 22, 1975, entitled "METHOD OF MAKING POLYGONALLY WRAPPED PAPER TUBE".

Instead of a pallet made from used wood or synthetic resin, a pallet made of paper has been recently developed and used in the transport of freight. In general, a paper pallet comprises an upper plate on which freight is placed, and a support member which is attached to a lower surface of the upper plate to support the upper plate. As a support member of a paper pallet, a paper tube having a quadrangular cross section is widely used.

Methods and apparatuses for manufacturing a paper tube having a quadrangular cross section are disclosed in International Publication No. WO 97/13695, Korean Patent Laid-Open Publication No. 2002-0038467 and Japanese Patent Publication Laid-Open No. (Sho) 50-91808. The apparatus for manufacturing a polygonally wrapped paper tube disclosed in the aforementioned patent documents causes a plurality of paper strips previously coated with adhesive to be supplied to a rotating core having a quadrangular cross section and to be wound on an outer peripheral surface of the core. The apparatus is also provided with a plurality of rollers rotating about a rotational axis of the core at the same angular velocity as the core, wherein the plurality of rollers press the strips wound on the outer peripheral surface of the core and simultaneously rotate in a longitudinal direction of the core (rotate about the rotational axis perpendicular to the longitudinal direction of the core). That is, the apparatus for manufacturing a polygonally wrapped paper tube uses the principle that when a plurality of the rollers rotate in the longitudinal direction of the core while pressing the strips (paper tube) wound on the core, the paper tube wound on the core is separated from the core and discharged in the longitudinal direction of the core if a friction force generated between the rollers and an outside surface of the paper tube is greater than that generated between the core and an inside surface of the paper tube.

According to a method for manufacturing a quadrangularly wrapped paper tube disclosed in U.S. Pat. No. 4,120,523, a quadrangularly wrapped paper tube is manufactured by successively forming a circularly wrapped paper tube, which is continuously formed and discharged, to have a quadrangular cross section using a plurality of forming rollers.

The foregoing discussion is to provide general background information, and does not constitute an admission of prior art.

SUMMARY

One aspect provide a tube comprising a hollow polygonal cross-sectional body of a plurality of layers, which may comprise at least one corrugated paper layer, wherein at least one of the plurality of layers may comprise at least one continuous paper band that is spirally arranged so as to define a polygonal cross-section.

In the foregoing tube, the at least one corrugated paper layer may comprise at least one continuous corrugated paper band that is spirally arranged so as to define a polygonal cross-section. Each continuous corrugated paper band may comprise a non-corrugated paper band and a corrugated paper structure bonded onto the non-corrugated paper band. Each corrugated paper layer may extend free of a substantial gap between two neighboring portions of the continuous corrugated paper band. The plurality of layers may comprise an inner-most layer, an outer-most layer, and at least one intermediate layer, wherein the at least one intermediate layer may comprise the at least one corrugated paper layer. The at least one of the inner-most layer and the outer-most layer does not comprise a corrugated paper band. Each layer may comprise a paper material.

Still in the foregoing tube, the plurality of layers may comprise a non-corrugated paper layer comprising a non-corrugated continuous paper band that is spirally arranged so as to define a polygonal cross-section, wherein a portion of the continuous, non-corrugated paper band may be overlapping with another portion of the continuous, non-corrugated paper band in the spiral arrangement, wherein the overlapping portions may be glued together. Each corrugated paper layer may comprise a continuous corrugated paper band that is spirally arranged so as to define a polygonal cross-section, wherein the continuous corrugated paper band does not comprise portions that are overlapping with each other in the spiral arrangement.

Another aspect of the invention provides an article comprising a tubular body extending in a longitudinal direction, wherein the tubular body has a polygonal cross-section in a plane generally perpendicular to the longitudinal direction, wherein the tubular body may comprise a first layer and a second layer, wherein the second layer may comprise a continuous paper band that is spirally arranged around the first layer, wherein at least one of the first and second layers may comprise corrugated paper.

In the foregoing article, the article may further comprise a plurality of additional tubular body arranged together so as to form a pallet. The first layer may be the inner-most layer of the tubular body and may comprise a continuous paper band that is spirally arranged so as to define a polygonal cross-section. The first layer does not comprise the corrugated paper. The second layer may comprise a continuous corrugated band that is spirally arranged so as to define a polygonal cross-section around the first layer, wherein the continuous corrugated band may comprise a continuous, non-corrugated band and the corrugated paper, which is bonded onto the continuous, non-corrugated band. The second layer may extend substantially free of a gap between two neighboring portions of the continuous corrugated band. The tubular body may further comprise a third layer interposed between the first and second layers, wherein the third layer may comprise the corrugated paper.

Still another aspect of the invention provides a method of making a hollow tube, which comprise: spirally winding a plurality of bands around at least one rotating shaft so as to form a tubular body comprising a plurality of layers around the at least one shaft, wherein the tubular body may comprise an inner surface; frictionally engaging the inner surface with a friction surface movable in the tubular body; and moving the friction surface so as to transfer the tubular body in a longitudinal direction thereof.

In the foregoing method, frictionally engaging and moving may occur substantially simultaneously. Frictionally engaging and moving occurs substantially continuously. The friction surface may be part of a conveyor belt, a roller or a lead screw driven by a dedicated power source therefor. The at least one shaft may comprise a plurality of edges extending in the longitudinal direction, wherein the plurality of bands may be winding around the plurality of edges such that the tubular body has a polygonal cross-section. The method may further comprise cutting the tubular body transferred away from the friction surface, wherein prior to cutting, the method does not comprise substantially changing the polygonal cross-sectional shape of the tubular body. The tubular body may be continuously moving generally in the longitudinal direction such that the plurality of bands are wound around a substantially identical portion of the at least one shaft. The plurality of bands may comprise at least one corrugated paper band so as to form at least one corrugated paper layer.

An aspect of the present invention is to provide a method and apparatus for manufacturing a polygonal paper tube, wherein a thick paper tube having high strength can be produced and its productivity can also be improved since it is possible to continuously produce the paper tube by helically winding strips on a core to overlap each other. Another aspect of the present invention is to provide a method and apparatus for producing a polygonal paper tube using corrugated cardboard strips. A further aspect of the present invention is to provide a polygonal paper tube having superior strength produced according to the foregoing method. An aspect of the present invention provides a method for manufacturing a paper tube having a polygonal cross section. The method for manufacturing a paper tube having a polygonal cross section comprises steps of winding a plurality of paper strips on an outer peripheral surface of a rotating core having a polygonal cross section to be helically overlapped, the paper strips except the lowermost strip being previously coated with adhesive; and delivering continuously a plurality of the paper strips wound on the core in a longitudinal direction of the core by bring a delivery member into contact with an inner surface of the lowermost strip wound on the outer peripheral surface of the core, the delivery member having at least a portion continuously exposed from the outer peripheral surface of the core on which the strips are wound, the delivery member being installed in the core to move in the longitudinal direction of the core.

The method for manufacturing a paper tube according to embodiments of the present invention does not discharge a paper tube from a core by pressing an outside surface of the paper tube formed by winding strips on the core as in an exemplary method for manufacturing a polygonal paper tube, but is an originative method in that a paper tube helically overlapped and wound on a core is continuously separated from the core by causing a delivery member, which is brought into contact with an inside surface of paper tube formed by winding strips on the core, to continuously move toward a free end of the core.

In order to easily separate the paper tube from the core, in the method for manufacturing a paper tube according to embodiments of the present invention, it is also preferred that the step of delivering be performed while an upper surface of a plurality of the wound strips corresponding to a position with which the delivery member is brought into contact is pressed with a pressing means at the same time, the pressing means being installed to a frame and rotating at the same angular velocity as the core. As the delivery member used in the method of embodiments of the present invention, delivery belts, delivery gears, or delivery screws may be used. The delivery member is installed in the core so that a portion of the delivery member is exposed from the outer peripheral surface of the core and moves in the longitudinal direction of the delivery member.

An aspect of the present invention, there is provided an apparatus for manufacturing a paper tube having a polygonal cross section. The apparatus for manufacturing a paper tube having a polygonal cross section according to embodiments of the present invention comprises a frame; an elongate core assembly having an end rotatably supported to the frame and the other free end to helically overlap and wind a plurality of paper strips on an outer peripheral surface of the core assembly, the paper strips except the lowermost strip being previously coated with adhesive, the outer peripheral surface of the core assembly having a predetermined polygonal shape; a first driving means for providing power for rotating the core assembly; a first power transmitting means for transmitting the power of the first driving means to the core assembly after receiving the power; a delivery member installed to the core assembly for at least a portion of the delivery member to be exposed from the outer peripheral surface of the core assembly on which the strips are wound, the delivery member being installed for the exposed portion to move toward the free end of the core assembly after receiving the power, whereby the continuously exposed portion is brought into contact with an inner surface of the lowermost one of a plurality of the strips wound on the outer peripheral surface of the core assembly and thus a plurality of the strips wound on the core assembly continuously move toward the free end of the core assembly; a second driving means for providing power for causing the portion of the delivery member to be continuously exposed from the outer peripheral surface of the core assembly; and a second power transmitting means for transmitting the power of the second driving means to the delivery member after receiving the power.

As the core assembly rotates, the delivery member installed to the core assembly causes the lowermost paper strip of a plurality of the paper strips helically wound on the outer peripheral surface to move toward the free end of the core assembly. Contrary to an apparatus disclosed in the references discussed above, which causes an inner peripheral surface of a paper tube to be slid and discharged from a core by pressing an outer peripheral surface of the wound paper tube with rollers, the apparatus for manufacturing a polygonal paper tube according to embodiments of the present invention causes the delivery member to be brought into contact with the inner peripheral surface of the wound polygonal paper tube and to push and discharge the paper tube toward the free end of the core, so that a friction force between the core and the polygonal paper tube is small and thus it is possible to manufacture a thicker paper tube. That is, a paper tube is manufactured by discharging a plurality of paper strips (paper tube) wound on the outer peripheral surface of the core assembly toward the free end of the core assembly by a friction force generated when a portion of the delivery member which is continuously exposed from the outer peripheral surface of the core assembly is brought into contact with the inside surface of the lowermost paper strip.

Also, the apparatus for manufacturing a paper tube according to embodiments of the present invention can advantageously manufacture a polygonal paper tube using one-sided corrugated cardboard strips. Since an apparatus disclosed in the references discussed above presses an outer peripheral surface of paper strips wound on a core, if one-sided corrugated cardboard strips are used when a polygonal paper tube is manufactured, corrugations of the corrugated cardboard strips are damaged and thus it is impossible to use corrugated cardboard strips. However, in the apparatus for manufacturing a polygonal paper tube according to embodiments of the present invention, a portion of the delivery member which is installed in the core assembly and continuously exposed from the outer peripheral surface of the core assembly is brought into contact with corrugated cardboard strips wound on the core assembly and pushes the wound paper tube toward the free end of the core assembly to discharge the paper tube from the core assembly, so that corrugations of the corrugated cardboard strips are not damaged.

Also, in the apparatus for manufacturing a paper tube having a polygonal cross section according to embodiments of the present invention, the first power transmitting means includes a first hollow rotational shaft rotatably supported to the frame to rotate after receiving the power from the first driving means and formed with a through-hole in a longitudinal direction of the first rotational shaft, and a coupling member having a side connected to the first rotational shaft and the other side connected to the core assembly; and the second power transmitting means includes a second rotational shaft rotatably supported to the first rotational shaft, the second rotational shaft being inserted into the through-hole of the first rotational shaft to rotate after receiving the power from the second driving means, and a third power transmitting means for transmitting the rotational power of the second rotational shaft to the delivery member. That is, the first rotational shaft for transmitting the power of the driving means (motor) for rotating the core assembly is formed to be hollow and the second rotational shaft for transmitting the power of the driving means (servo motor) for driving the delivery member is installed to rotate in the hollow of the first rotational shaft, so that it is possible to reduce a size of the apparatus for manufacturing a paper tube and to stably transmit power.

Also, in the apparatus for manufacturing a paper tube having a polygonal cross section according to embodiments of the present invention, delivery belts, delivery gears or delivery screws may be used as the delivery member. When delivery belts are used as the delivery member, a pair of delivery belts are installed for portions of the delivery belts to be exposed from opposite portions of the outer peripheral surface of the core assembly along the longitudinal direction thereof, and the exposed portions of the delivery belts are installed to move toward the free end of the core assembly. Also, the third power transmitting means further includes a third rotational shaft rotatably installed to the coupling member to be perpendicular to the second rotational shaft, a pair of bevel gears which are respectively installed on the second and third rotational shafts and meshed with each other to transmit the power of the second rotational shaft to the third rotational shaft, and a fourth power transmitting means for transmitting the rotational power of the third rotational shaft to a pair of the delivery belts.

When the delivery belts are used as the delivery member, it is possible to increase the strength of the delivery member by fixing a pair of delivery guide members for guiding the movement of the delivery belts to a quadrangular rod core of the core assembly. It is also possible to easily change a width of the paper tube to be manufactured by installing the delivery belts to upper and lower cores and controlling a gap between the upper and lower cores.

In a case where a core assembly is configured using a single quadrangular rod core and delivery guide members, the core assembly comprises an elongate quadrangular rod core with an end fixed to the coupling member and a pair of elongate delivery guide members fixed to both opposite side surfaces of the quadrangular rod core, each of the delivery guide members including a base portion having a width larger than that of the quadrangular rod core and fixed to each of both the side surface of the quadrangular rod core and upper and lower guide wing portions protruding in parallel from both widthwise ends of each base portion toward the opposite one of the base portions spaced apart from each other and extending by a predetermined length in the longitudinal direction of the delivery guide member; a pair of the delivery belts are installed to be wound on the opposite upper guide wing portions and the opposite lower guide wing portions of a pair of the delivery guide members, respectively; and the fourth power transmitting means includes upper and lower belt driving shafts which are rotatably installed to the fixed end of the quadrangular rod core of the core assembly and on which the upper and lower delivery belts are respectively wound, upper and lower idle rollers which are rotatably installed to the free ends of the delivery guide members of the core assembly to be spaced apart from each other and on which the upper and lower delivery belts are respectively wound, and gears for transmitting the power of the third rotational shaft to the upper and lower belt driving shafts.

In a case where a core assembly is configured using upper and lower cores, the core assembly comprises an elongate upper core with an end fixed to the coupling member and an elongate lower core with an end fixed to the coupling member, the lower core being spaced apart by a predetermined distance from the upper core; a pair of the delivery belts are installed to be wound on the upper and lower cores in the longitudinal direction, respectively; the fourth power transmitting means includes upper and lower belt driving shafts which are rotatably installed to the fixed ends of the upper and lower cores and on which the upper and lower delivery belts are wound, respectively, upper and lower idle rollers which are rotatably installed to the free ends of the upper and lower cores and on which the upper and lower delivery belts are wound, respectively, and a power transmitting means for transmitting the power of the third rotational shaft to the upper and lower belt driving shafts, respectively.

In a case where delivery gears are used as the delivery member, at least a pair of delivery gears are installed to be rotatable about a rotational shaft installed perpendicular to the longitudinal direction of the core assembly and are installed for portions of the delivery gears to be exposed from opposite portions of the outer peripheral surface of the core assembly. Also, the third power transmitting means further includes a third rotational shaft rotatably installed to the coupling member to be perpendicular to the second rotational shaft, a pair of bevel gears which are respectively installed on the second and third rotational shafts and meshed with each other to transmit the power of the second rotational shaft to the third rotational shaft, and a fifth power transmitting means for transmitting the rotational power of the third rotational shaft to a pair of the delivery gears.

When delivery screws are used as the delivery member, an end of each delivery screw is rotatably installed to the coupling member for a portion of the delivery screw to be exposed from the outer peripheral surface of the core assembly in the longitudinal direction thereof, and the other end of each delivery screw is rotatably installed to the core assembly. Also, the third power transmitting means includes a driving gear installed to the second rotational shaft, and a plurality of driven gears fixedly installed to the ends of the delivery screws to be meshed with the driving gear, respectively.

In addition, the apparatus for manufacturing a paper tube having a polygonal cross section according to embodiments of the present invention further comprises a means for preventing the free end of the core assembly from vibrating in order to operate the apparatus safely, for discharging a paper tube to the free end of the core assembly without slip, and for keeping a discharged paper tube to have a polygonal shape. The apparatus for manufacturing a paper tube having a polygonal cross section according to embodiments of the present invention further comprises a fourth hollow rotational shaft installed to be supported to the frame and to rotate at the same angular velocity as the core assembly, the fourth rotational shaft being formed with a through-hole through which the paper tube of a plurality of the wound strips passes, the paper tube being discharged toward the free end of the core assembly, and a pressing means fixed to the fourth hollow rotational shaft to symmetrically press an upper surface of the uppermost one of a plurality of the strips wound on the free end of the core assembly. Preferably, the pressing means is supported by an elastic member to press the paper tube at constant pressure.

Also, the apparatus for manufacturing a paper tube having a polygonal cross section according to embodiments of the present invention further comprises a paper tube cutting means for cutting the paper tube continuously manufactured and discharged toward the free end of the core assembly by an appropriate length. The paper tube cutting means includes a base installed to the frame to be movable in the longitudinal direction of the core assembly, and a cutter installed to the base to be movable in the direction perpendicular to the longitudinal direction of the core assembly. Preferably, a rotating circular cutter or a saw blade is used as the cutter. In addition, the paper tube cutting means further comprises a fourth hollow rotational shaft installed to be supported to the base and to rotate at the same angular velocity as the core assembly and formed with a through-hole through which the paper tube of a plurality of the wound strips passes, the paper tube being discharged toward the free end of the core assembly.

A further aspect of the present invention provides a paper tube manufactured by the method for manufacturing a paper tube having a polygonal cross section according to embodiments of the present invention. Particularly, in the paper tube manufactured by the method according to embodiments of the present invention, a plurality of paper strips used for manufacturing a paper tube preferably includes at least a one-sided corrugated cardboard strip.

DETAILED DESCRIPTION OF EMBODIMENTS

Various embodiments of the invention will be described below.

According to the methods and apparatuses for manufacturing a quadrangular paper tube, disclosed in all the aforementioned documents and discussed in the foregoing background section, it is difficult to continuously manufacture a polygonal paper tube of a predetermined thickness or more, for example, a quadrangular paper tube of a thickness of at least 5 mm by helically winding the paper tube.

According to the method for manufacturing a polygonal paper tube by winding a plurality of paper strips on a rotating polygonal core and then pressing an outer peripheral surface of the wound paper strips with a plurality of rollers and simultaneously separating the paper tube from the core, discussed in the foregoing background section, when a paper tube is thick, a pressing force of the roller should be significantly great in order to increase a friction force between the rollers and the paper tube. However, since the friction force between the core and an inside surface of the paper tube is increased as the pressing force of the rollers is increased, there is a problem in that it is difficult to separate the paper tube from the core. According to the method for forming a circular paper tube into a quadrangular paper tube, discussed in the foregoing background section, there is a problem in that it is theoretically impossible to make a paper tube having an accurate quadrangular cross section since a perimeter of a circle is not accurately identical to a perimeter of a quadrangle. Further, there is a problem in that when a thickness of the paper tube is greater than a predetermined thickness, a gap between the inner wound strip and the outer wound strip is increased and thus the paper tube is distorted while it is formed.

Furthermore, when the method for manufacturing a polygonal paper tube discussed in the background section is applied to corrugated cardboard strips, the corrugations of the corrugated cardboard strips can be damaged, and thus it is impossible to manufacture a polygonal paper tube using strips of corrugated cardboard strips.

Figure 1:
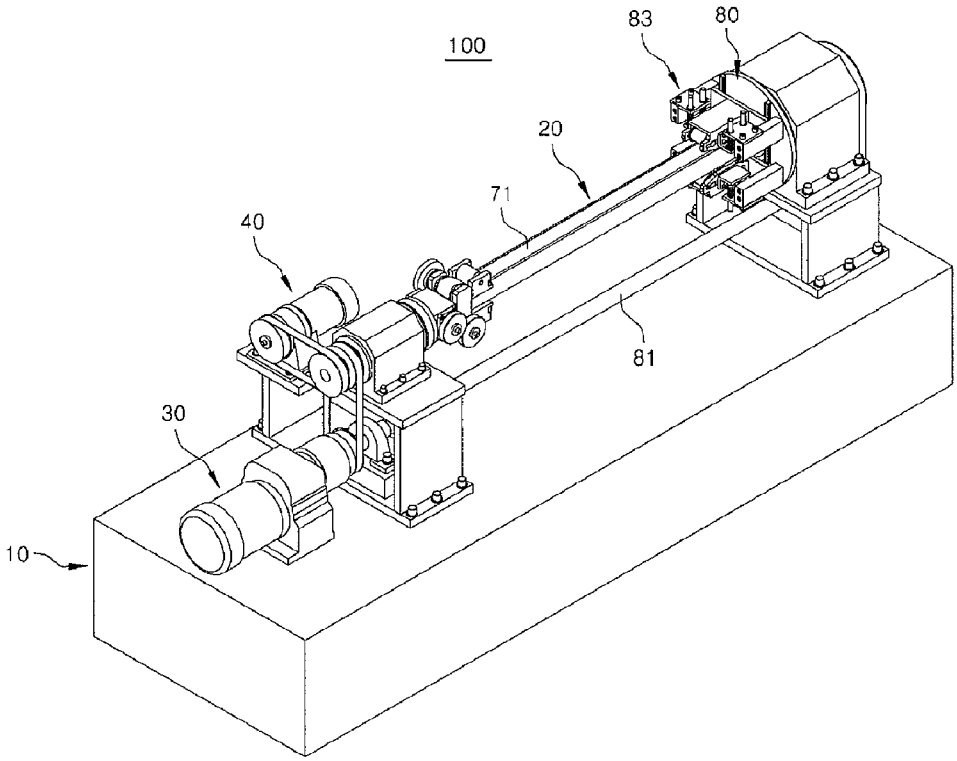
FIG. 1 is a perspective view of an apparatus for manufacturing a paper tube having a polygonal cross section according to an embodiment of the present invention.
Figure 2:
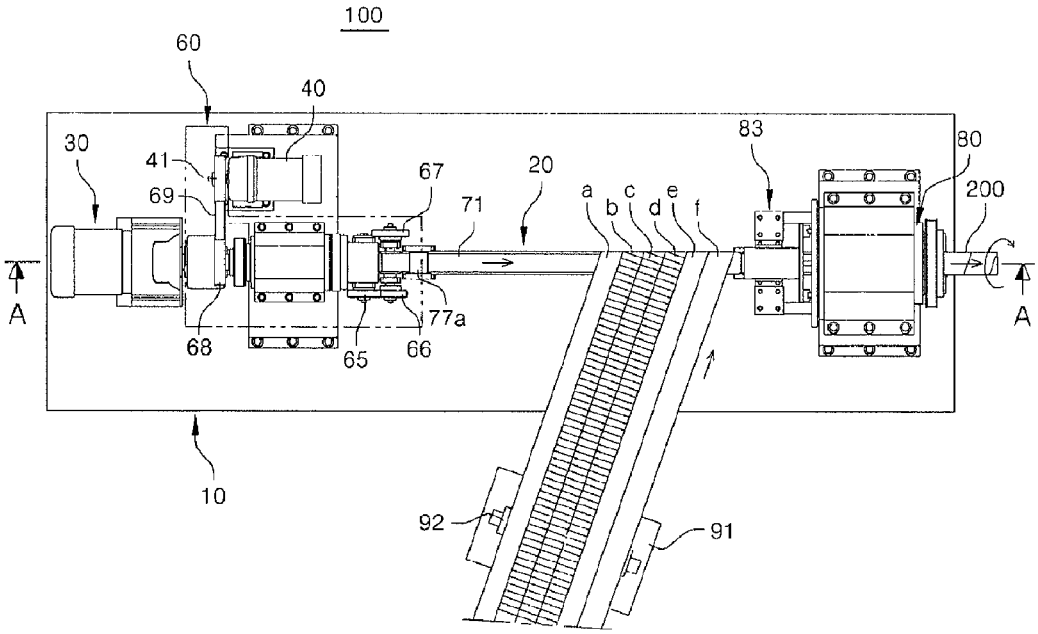
FIG. 2 is a plan view illustrating a state where a plurality of paper strips are wound around the paper tube manufacturing apparatus shown in FIG. 1.
Figure 3:
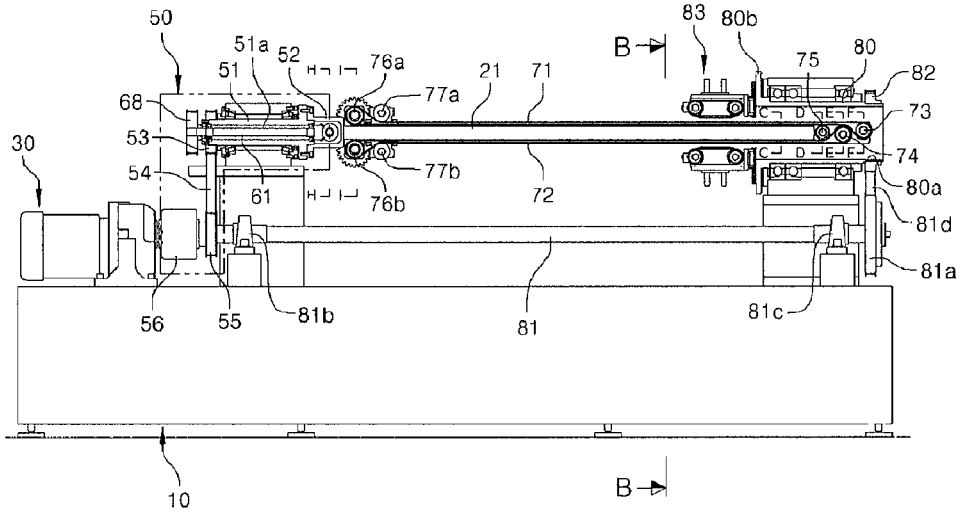
FIG. 3 is a sectional view taken along line A-A of FIG. 2.

FIG. 1 is a perspective view of an apparatus for manufacturing a paper tube having a polygonal cross section according to an embodiment of the present invention, FIG. 2 is a plan view illustrating a state where a plurality of paper strips are wound around the paper tube manufacturing apparatus shown in FIG. 1, and FIG. 3 is a sectional view taken along line A-A of FIG. 2.

Referring to FIGS. 1 to 3, an apparatus 100 for manufacturing a paper tube having a polygonal cross section according to the present embodiment comprises a frame 10, a core assembly 20 having an end rotatably supported to the frame 10 and the other free end, a delivery member for continuously moving a plurality of paper strips a, b, c, d, e, and f, which are previously coated with adhesive and are helically wound on the core assembly 20 to overlap each other, toward the free end of the core assembly 20. In the present embodiment, the delivery member includes a pair of delivery belts 71 and 72.

Referring to FIG. 2, the core assembly 20 is narrow and elongate and has a quadrangular cross section. When the core assembly 20 rotates with power received from a first driving means 30, a plurality of the paper strips a, b, c, d, e, and f are helically wound on an outer circumferential surface of the core assembly 20 to overlap each other, wherein the paper strips except the paper strip a are previously coated with adhesive. In FIG. 2, unexplained reference numeral 91 designates an adhesive supply device for coating the strip with adhesive, and reference numeral 92 designates an adhesive coating roller. Referring to FIG. 3, the frame 10 is equipped with the first driving means 30 for providing power needed to rotate the core assembly 20, and a first power transmitting means 50 for receiving the power from the first driving means 30 and transmitting the received power to the core assembly 20. Further, referring to FIG. 2, the frame 10 is equipped with a second driving means 40 for providing power to a pair of the delivery belts 71 and 72, and a second power transmitting means 60 for receiving the power from the second driving means 40 and transmitting the received power to a pair of the delivery belts 71 and 72. The first and second driving means 30 and 40 preferably include motors. Particularly, it is more preferably that a servomotor be used as the second driving means to control a discharge velocity of a paper tube 200 after receiving a velocity of the paper tube 200 and a rotational velocity of the core assembly 20 as feedback signals.

Further, in the apparatus 100 for manufacturing a paper tube of the present embodiment, a fourth rotational shaft 80 is installed to the frame 10 so as to rotate at the same angular velocity as the core assembly 20. The fourth rotational shaft 80 is formed with a through-hole 80*a* through which the paper tube 200 passes, wherein the paper tube 200 is continuously discharged toward the free end of the core assembly 20. At an end of the fourth rotational shaft 80 which is hollow, there is installed a pressing means 83 for pressing the paper tube to prevent the free end of the core assembly 20 from vibrating, to allowing the paper tube 200 to be discharged toward the free end of the core assembly 20 without slip, and to keep the paper tube to be quadrangle-shaped. The pressing means 83 is fixed to the fourth rotational shaft 80, rotates at the same angular velocity as the fourth rotational shaft, and symmetrically presses opposite side surfaces of the polygonal paper tube 200, which is discharged toward the free end of the core assembly 20 by a pair of the delivery belts 71 and 72. In order to transmit the power for rotating the fourth hollow rotational shaft 80, to which the pressing means 83 is fixed, at the same angular velocity as the core assembly 20, a driven pulley 82 is fixed to an end of the fourth hollow rotational shaft 80. Also, in the frame 10, a transmission shaft 81 for transmitting power to the driven pulley 82 is supported by a pair of bearings 81*b* and 81*c* and connected to the first driving means 30. In addition, a driving pulley 81*a* for transmitting power to the driven pulley 82 is fixed to the end of the transmission shaft 81, and the driving pulley 81 a and the driven pulley 82 are connected to each other with a timing belt 81*d*. By appropriately determining diameters of the driving pulley 81*a* and the driven pulley 82, it is possible for the core assembly 20 and the fourth rotational shaft 80 to have the same rotational velocity.

Referring to FIG. 3, the first power transmitting means 50 for receiving power from the first driving means 30 and transmitting the power for rotating the core assembly 20 is schematically shown within a dotted line. The first power transmitting means 50 includes a first hollow rotational shaft 51 rotatably supported to the frame 10 by bearings and formed with a through-hole 51*a* and a coupling member 52 having a side connected to the first rotational shaft 51 and the other side to which the core assembly 20 is fixed. The first rotational shaft 51, the coupling member 52 and the core assembly 20 are integrally fixed to each other to have the same rotational center, and thus, rotate at the same angular velocity. A pulley 53 is fixed to the other end of the first hollow rotational shaft 51 and is connected through a belt 54 to the pulley 55 connected to the rotational shaft of the first driving means 30. Unexplained reference numeral 56 designates a reducer. When the motor 30 rotates, power is transmitted to the core assembly 20 through the pulley 55, the belt 54, the pulley 53, the first rotational shaft 51, and the coupling member 52, whereby the core assembly 20 rotates. In addition, when the motor 30 rotates, the power is transmitted to the pressing means 83 through the transmission shaft 81, the pulley 81*a*, the belt 81*d*, the pulley 82, and the fourth hollow rotational shaft 80, whereby the pressing means presses the paper tube 200 and at the same time rotates at the same angular velocity as the core assembly 20.

Figure 9:
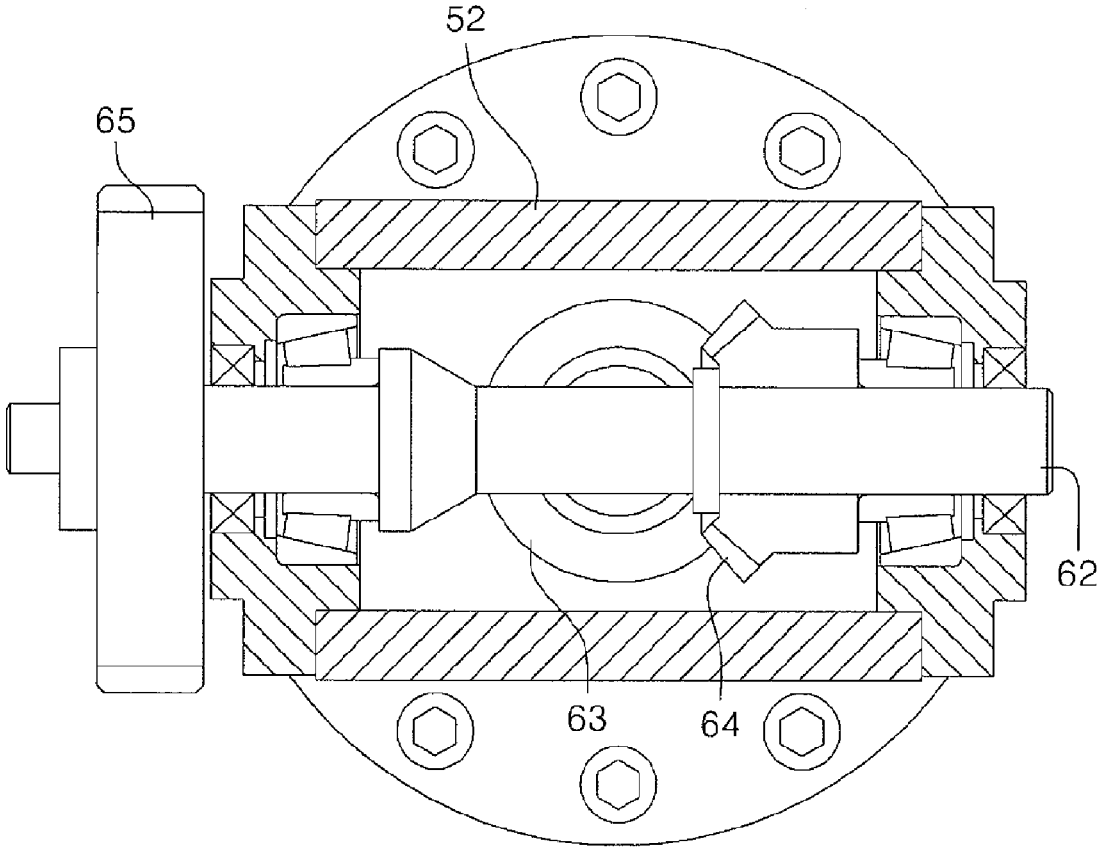
FIG. 9 is a sectional view taken along line H-H of FIG. 3.

Referring to FIG. 2, the second power transmitting means 60 for transmitting the power for driving a pair of the delivery belts 71 and 72 installed to the core assembly after receiving the power from the second driving means 40 is schematically shown within a dotted line. Referring to FIG. 3, the second power transmitting means 60 includes a second rotational shaft 61 inserted into the through-hole 51*a* of the first rotational shaft 51 and rotatably supported by bearings and a third power transmitting means for transmitting rotational power of the second rotational shaft 61 to the delivery belts 71 and 72. Referring to FIG. 9 which is a sectional view taken along line H-H of FIG. 3, the third power transmitting means includes a third rotational shaft 62 rotatably installed to the coupling member 52 to be perpendicular to the second rotational shaft 61, a bevel gear 63 installed to an end of the second rotational shaft 61 for transmitting the power of the second rotational shaft 61 to the third rotational shaft 62 arranged to be perpendicular thereto, and a bevel gear 64 meshed with the bevel gear 63 for perpendicularly transmitting the power thereto and installed on the third rotational shaft 62. In addition, the third power transmitting means includes a fourth power transmitting means for transmitting the power of the third rotational shaft 62 to a pair of the delivery belts 71 and 72 installed to the core assembly 20.

Figure 4:
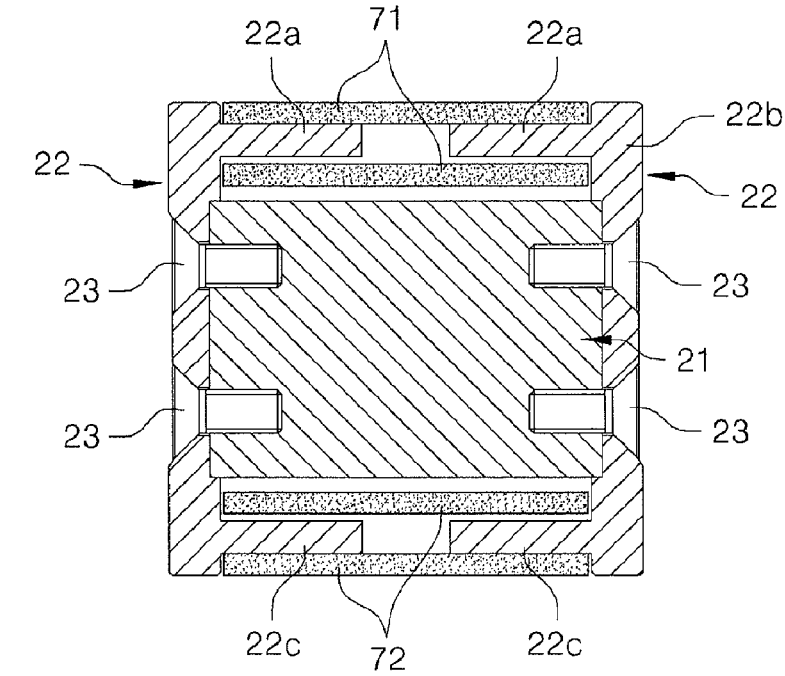
FIG. 4 is a sectional view taken along line C-C of FIG. 3.

FIG. 4 is a sectional view taken along line C-C of FIG. 3. Referring to FIGS. 3 and 4, the core assembly 20 includes an elongate quadrangular rod core 21, and a pair of elongate delivery guide members 22 fixed at both opposite side surfaces of the quadrangular rod core 21. An end of the quadrangular rod core 21 is fixed to the coupling member 52 while the other free end is inserted into the through-hole 80*a* of the fourth rotational shaft 80. Each of the delivery guide members 22 is provided with an elongate base portion 22*b* to be fixed to each of both the side surfaces of the quadrangular rod core 21, and upper and lower guide wing portions 22*a* and 22*c* extending from the base portion 22*b*. The base portion 22*b* has a width larger than that of the quadrangular rod core 21 and is fixed to each of both the side surfaces of the quadrangular rod core 21 with a plurality of bolts 23. The upper and lower guide wing portions 22*a* and 22*c* protrude in parallel from both widthwise ends of each base portion 22*b* toward the opposite one of the base portions 22*b* spaced apart from each other and extend by a predetermined length in a longitudinal direction. The upper guide wing portions 22*a* of a pair of the delivery guide members 22 are wound by the upper delivery belt 71 while the lower guide wing portions 22*c* of a pair of the delivery guide members 22 are wound by the lower delivery belt 72.

Figure 8:
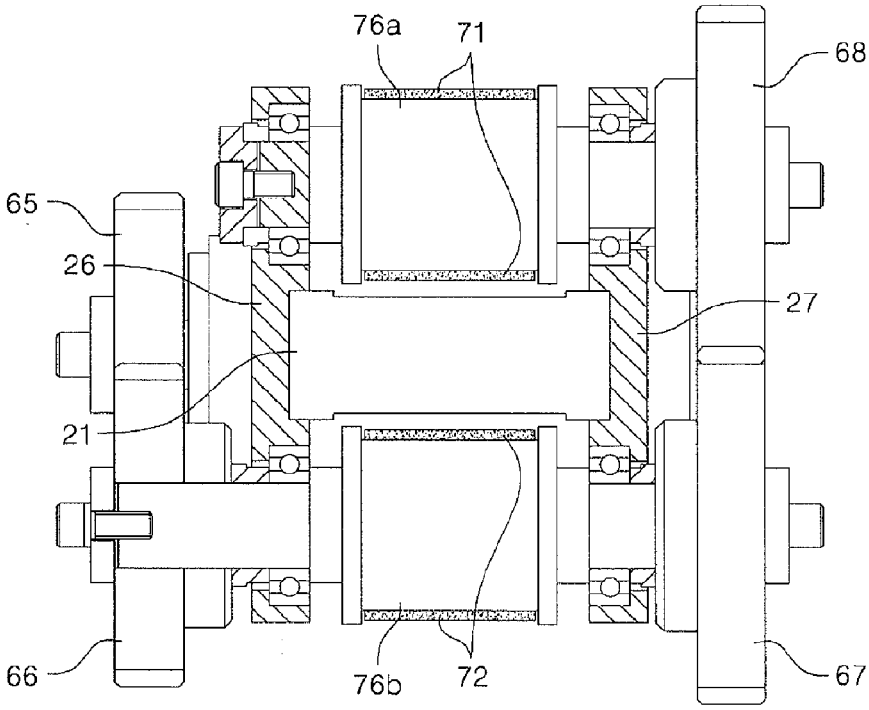
FIG. 8 is a sectional view taken along line I-I of FIG. 3.

Referring to FIGS. 3, 8 and 9, the fourth power transmitting means for transmitting the rotational power transmitted to the third rotational shaft 62 to a pair of the delivery belts 71 and 72 includes upper and lower belt driving shafts 76*a* and 76*b* and upper and lower idle rollers 73 and 74. The upper and lower belt driving shafts 76*a* and 76*b* are rotatably installed at the fixed end of the quadrangular rod core 21. The upper and lower idle rollers 73 and 74 are rotatably installed to be spaced apart by a predetermined length from each other at the free ends of the delivery guide members 22, respectively. The upper and lower belt driving shafts 76*a* and 76*b* are installed to a pair of brackets 26 and 27 fixed to the quadrangular rod core 21 to be supported by bearings. The annular upper belt 71 is wound on the upper belt driving shaft 76*a*, is guided by the upper guide wing portions 22*a* inserted into the upper belt 71, and is wound on the upper idle roller 73. In addition, the annular lower belt 72 is wound on the lower belt driving shaft 76*b*, is guided by the lower guide wing portions 22*c* inserted into the lower belt 72, and is wound on the lower idle roller 74. That is, the upper delivery belt 71 is wound on the upper belt driving shaft 76*a* and the upper idle roller 73 and the upper guide wing portions 22*a* of the delivery guide members 22 are inserted into both the sides of the upper delivery belt 71 while the lower delivery belt 72 is wound on the lower belt driving shaft 76*b* and the lower idle roller 74 and the lower guide wing portions 22*c* of the delivery guide members 22 are inserted into both the sides of the lower delivery belt 72, whereby the upper and lower delivery belts 71 and 72 do not interfere with each other when they rotate.

In addition, FIG. 8 is a sectional view taken along line I-I of FIG. 3. Referring to FIGS. 8 and 9, the fourth power transmitting means is provided with gears 65, 66, 67 and 68 for respectively transmitting the rotational power of the third rotational shaft 62 to the upper and lower belt driving shafts 76*a* and 76*b*. Although gears, as the power transmitting means, are used in the present embodiment, the belt and pulleys may be used. The gear 65 fixed to an end of the third rotational shaft 62 is meshed with the gear 66 fixed to an end of the lower belt driving shaft 76*b*, while the gear 67 fixed to the other end of the lower belt driving shaft 76*b* is meshed with the gear 68 fixed to an end of the upper belt driving shaft 76*a*. Thus, when the gear 65 rotates in one direction, the upper and lower belt driving shafts 76*a* and 76*b* rotate opposite to each other. Therefore, by properly controlling the rotational direction of the gear 65, it is possible to cause the portions of the upper and lower delivery belts 71 and 72, which the paper strips are wound on and brought into contact with and which are respectively positioned above and below the upper and lower guide wing portions 22*a* and 22*c* and exposed to the outside, to move toward the free end of the core assembly.

In the present embodiment, the respective portions of the upper and lower delivery belts 71 and 72 positioned outside the guide wing portions 22*a* and 22*c* are the portions of the delivery member installed to the core assembly such that at least the portions can be exposed from the outer peripheral surface of the core assembly on which the strips are wound. As the delivery belts 71 and 72 rotates by means of the received power, the exposed portions of the delivery belts move toward the free end of the core assembly 20. The portions of the delivery belts 71 and 72 which move toward the free end, are continuously brought into contact with an inner peripheral surface of the polygonal paper tube 200 which is formed by helically winding a plurality of the paper strips on the outer peripheral surface of the core assembly 20, and cause the paper tube 200 to be discharged to the free end of the core assembly 20.

Referring to FIG. 3, idle rollers 77*a* and 77*b* rotatably installed to the quadrangular rod core 21 are movable so as to control tensions of the upper belt 71 and the lower belt 72, respectively. An idle roller 75 rotatably installed to the free end of the core assembly 20 is to guide the movement of the lower belt 72 and control the tension thereof. The movement guidance and tension control of the upper belt 71 can be performed by controlling the position of the lower idle roller 74.

Figure 5:
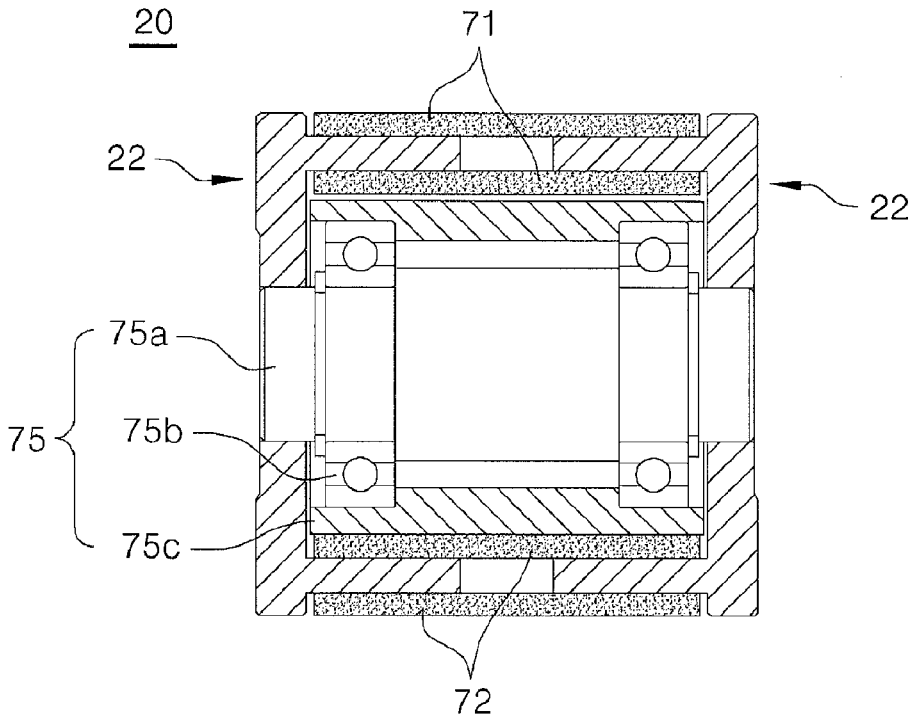
FIG. 5 is a sectional view taken along line D-D of FIG. 3.
Figure 6:
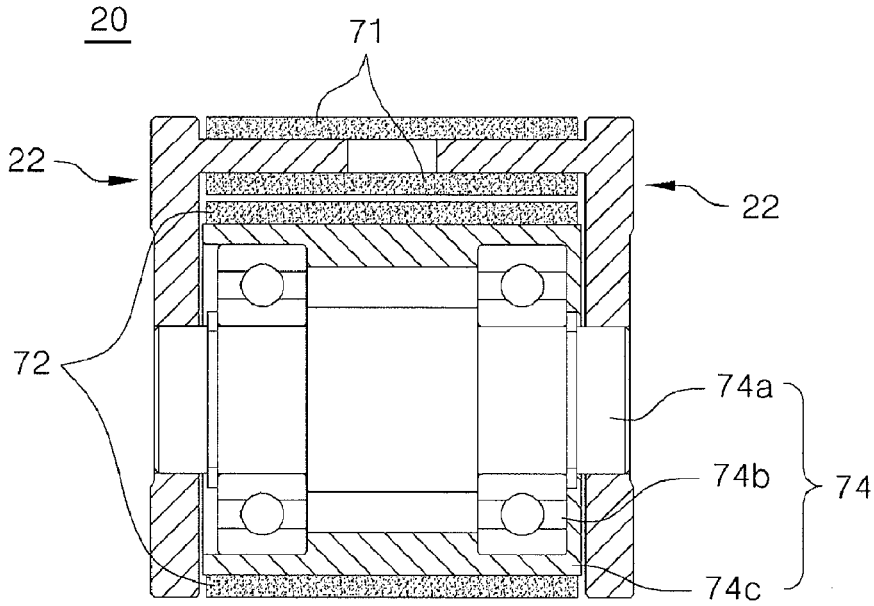
FIG. 6 is a sectional view taken along line E-E of FIG. 3.
Figure 7:
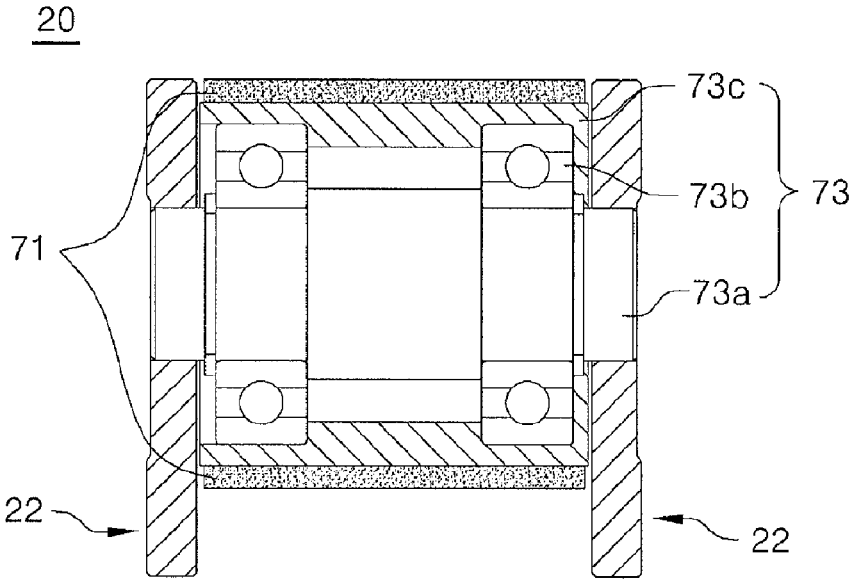
FIG. 7 is a sectional view taken along line F-F of FIG. 3.

FIG. 5 is a sectional view taken along line D-D of FIG. 3, which illustrates a state where the idle roller 75 is rotatably installed to the base portions 22*b* of the delivery guide members 22 by bearings is shown. FIG. 6 is a sectional view taken along line E-E of FIG. 3, which illustrates a state where the lower belt 72 is wound on the lower idle roller 74 that is rotatably installed to the base portions 22*b* of the delivery guide members 22 by bearings. FIG. 7 is a sectional view taken along line F-F of FIG. 3, which shows a state where the upper belt 71 is wound on the upper idle roller 73 that is rotatably installed to the base portions 22*b* of the delivery guide members 22 by bearings.

Figure 10:
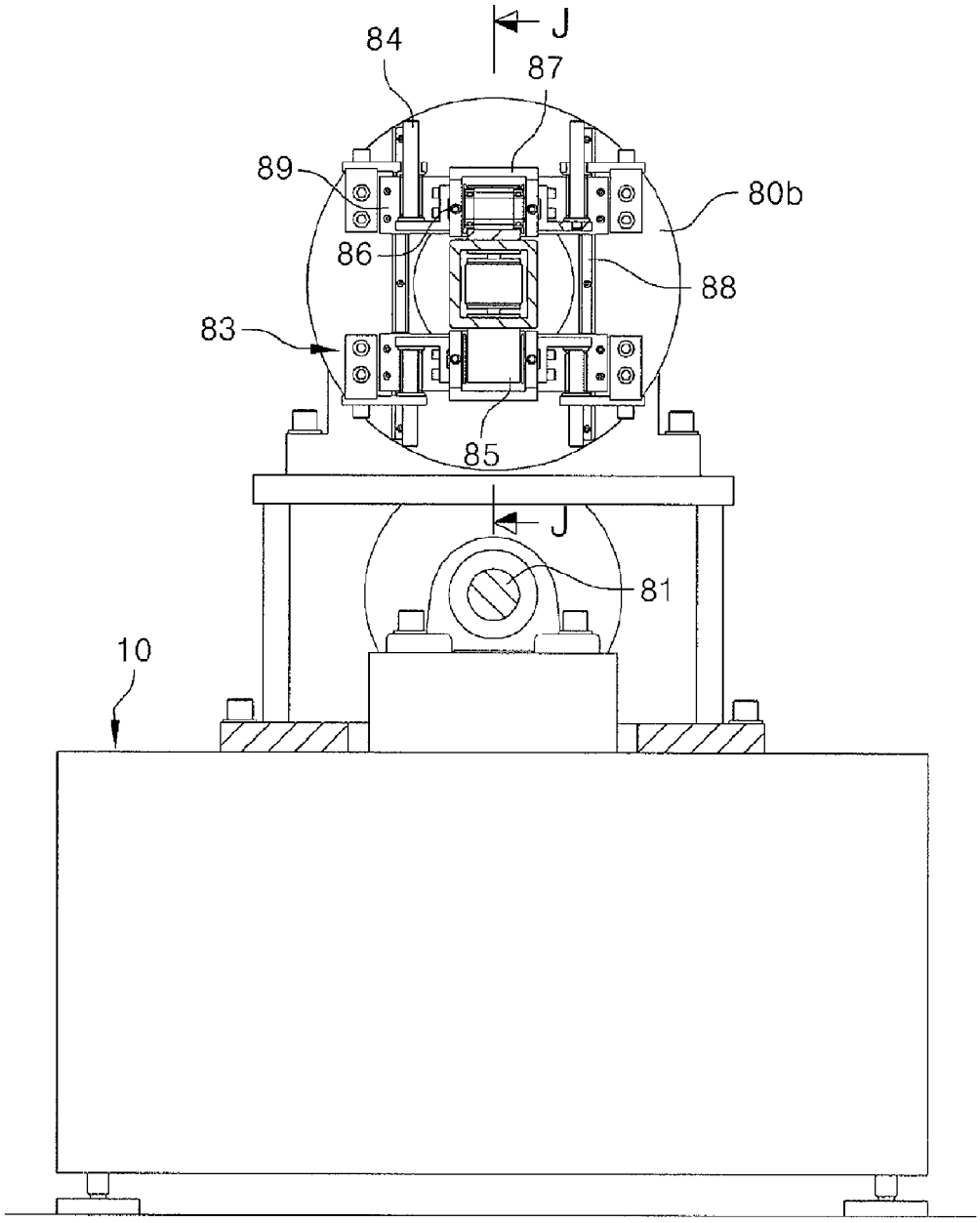
FIG. 10 is a sectional view taken along line B-B of FIG. 3.
Figure 11:
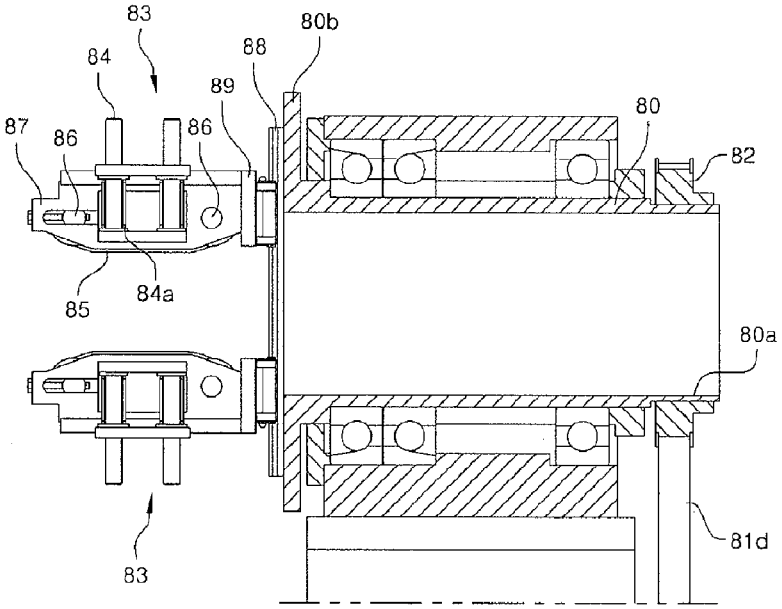
FIG. 11 is a sectional view taken along line J-J of FIG. 10.

Referring to FIGS. 1, 10 and 11, the pressing means 83 of the present embodiment include a pair of idle belts 85 installed above and below the core assembly 20 symmetrically to face the exposed surfaces of the upper and lower delivery belts 71 and 72. A pair of the idle belts 85 is wound on a pair of idle rollers 86 and circularly rotates. A pair of the idle rollers 86 is installed to brackets 89, and the brackets 89 are installed to housings 87 constrained to be vertically movable by the guide bars 84. Although in the present embodiment, the idle belts 85 are used for increasing the surface pressure pressing the outside surface of the paper tube 200, rollers or sliding plates may be used. Further, the bracket 89 is guided by linear guides 88 fixed to a flange portion 80*b* formed on the other end of the hollow fourth rotational shaft 80, and thereby can be vertically controlled. In addition, springs 84*a* are fitted around the guide bars 84, so that it is possible to press an upper surface of the formed paper tube at constant pressure.

Hereinafter, referring to FIGS. 2 and 3, the operation of the apparatus for manufacturing a paper tube according to the present embodiment will be described.

As shown in FIG. 2, a plurality of the strips are attached on the outer peripheral surface of the core assembly 20 to overlap each other slantly at a constant angle such that the strips except the lowermost strip are previously coated with adhesive. Next, when the motors, which are the first and second driving means 30 and 40, rotate together at an appropriate velocity ratio, the operation of the first power transmitting means 50 causes the core assembly 20 to rotate and simultaneously the operation of the second power transmitting means 60 causes the exposed portions of the upper and lower delivery belts 71 and 72 installed to the core assembly 20 to circularly move toward the free end of the core assembly 20. Thus, a plurality of the paper strips attached on the outer peripheral surface of the core assembly 20 are helically wound thereon and the wound strips (paper tube) 200 move simultaneously toward the free end of the core assembly 20 by means of the upper and lower delivery belts 71 and 72 brought into contact with the lowermost strip. Therefore, the paper tube is continuously formed by causing the strips to be wound and is discharged toward the free end. At this time, if the pressing means installed at a side of the free end presses the upper surface of the paper tube, the friction force between the upper and lower delivery belts 71 and 72 and the inside surface of the paper tube in contact therewith is increased, so that the friction force assists the paper tube to be discharged smoothly without slip between the delivery belts and the inside surface of the paper tube.

Figure 12:
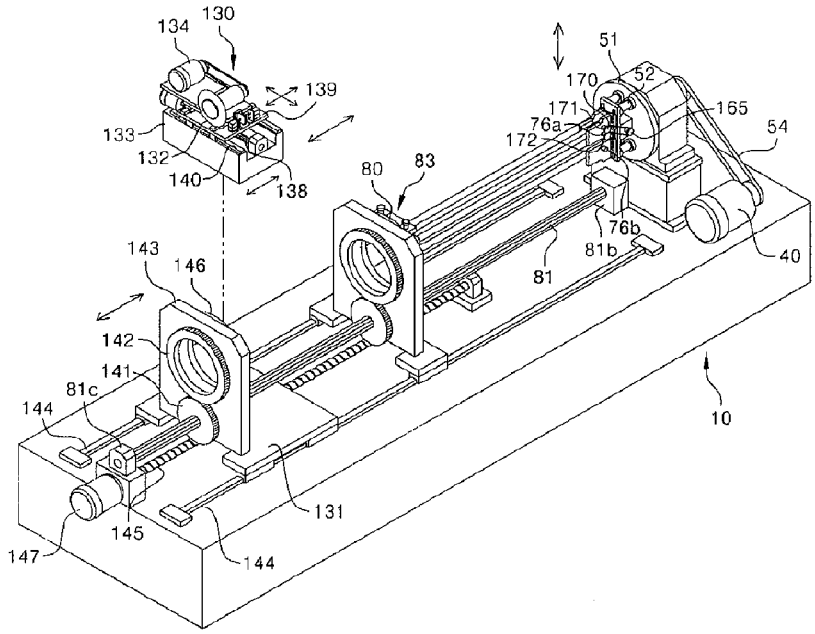
FIG. 12 is a perspective view illustrating an apparatus for manufacturing a paper tube having a polygonal cross section according to another embodiment of the present invention.
Figure 13:
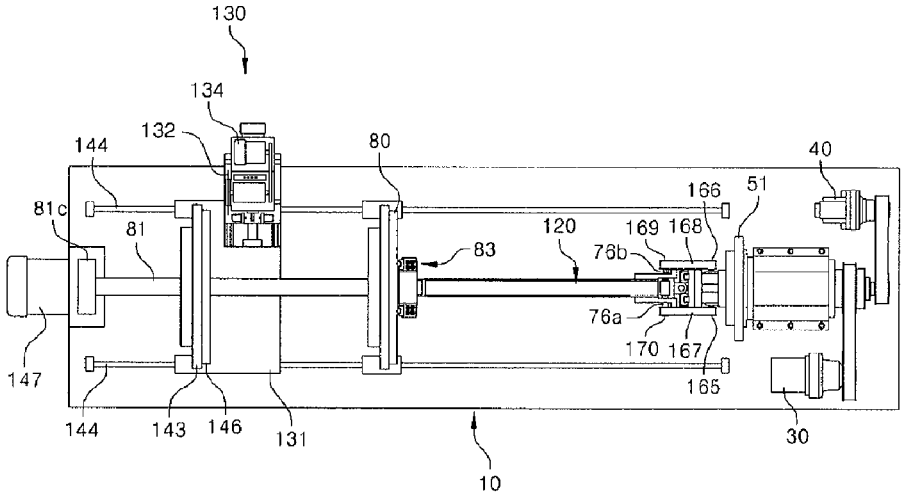
FIG. 13 is a plan view of an embodiment shown in FIG. 12.
Figure 14:
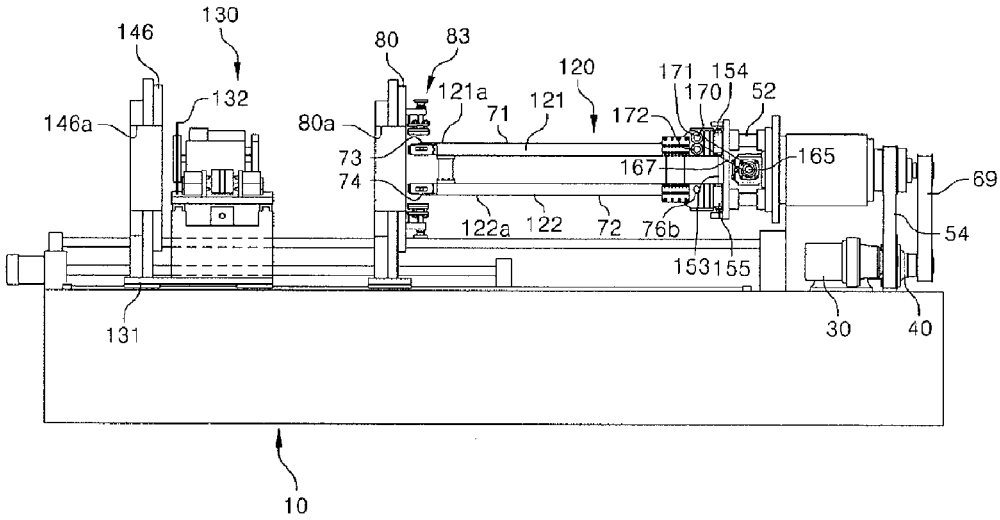
FIG. 14 is a front view of an embodiment shown in FIG. 12.

FIG. 12 is a perspective view illustrating an apparatus for manufacturing a paper tube having a polygonal cross section according to another embodiment of the present invention, FIG. 13 is a plan view of an embodiment shown in FIG. 12, and FIG. 14 is a front view of an embodiment shown in FIG. 12.

A core assembly of the present embodiment is different from an embodiment shown in FIG. 1 in that the core assembly of the present embodiment makes it possible to easily control a width of a paper tube to be manufactured by installing delivery belts to upper and lower cores and enabling the gap between the upper and lower cores to be controlled although an embodiment shown in FIG. 1 increases its strength by fixing a pair of the delivery guide members for guiding the movement of the delivery belts to the quadrangular rod core of the core assembly.

Referring to FIGS. 12 to 14, a core assembly 120 of the present embodiment includes an elongate upper core 121 with an end fixed to the coupling member 52 and an elongate lower core 122 with an end fixed to the coupling member 52, the lower core 122 being spaced apart from the upper core 121. In the present embodiment, the fourth power transmitting means for transmitting the rotational power transmitted to the third rotational shaft 62 shown in FIG. 9 to the upper and lower delivery belts 71 and 72 includes the upper and lower belt driving shafts 76*a* and 76*b* and the upper and lower idle rollers 73 and 74 in the same manner as an embodiment shown in FIG. 1. The upper and lower belt driving shafts 76*a* and 76*b* are rotatably installed to the fixed ends of the upper and lower cores 121 and 122, respectively, and the upper and lower idle rollers 73 and 74 are rotatably installed to free ends of the upper and lower cores 121 and 122, respectively. The annular upper belt 71 is wound on the upper belt driving shaft 76*a* and the upper idle roller 73, thereby being installed in a conveyor form which winds the upper core 121 in its longitudinal direction. The annular lower belt 72 is also wound on the lower belt driving shaft 76*b* and the lower idle roller 74, thereby being installed in a conveyor form which winds the lower core 122 in its longitudinal direction. In the present embodiment, the power transmitting means for respectively transmitting the rotational power of the third rotational shaft 62 to the upper and lower belt driving shafts 76*a* and 76*b* includes a pair of transmission belts 167 and 168 and a plurality of pulleys 165, 166, 169 and 170. The pulleys 165 and 166 are fixed to both ends of the third rotational shaft 62. The pulley 169 is connected to the lower belt driving shaft 76*b*, and the pulley 170, which is a medium for switching the rotational direction of the upper delivery belt 71, transmits power to the upper belt driving shaft 76*a* through a gear 172 fixed to the upper belt driving shaft and a gear 171 fixed to the pulley 170. That is, in order to cause a portion of the upper delivery belt 71 which covers an outside surface 121*a* of the upper core 121 and a portion of the lower delivery belt 72 which covers an outside surface 122*a* of the lower core 122 to move together toward the free end of the core assembly 120, a pair of the meshed gears 171 and 172 for transmitting power to the upper belt driving shaft 76*a* by switching the rotational direction of the pulley 170 are installed to the upper belt driving shaft 76*a* and a shaft of the pulley 170, respectively.

In the present embodiment, the portion of the upper delivery belt 71 positioned on the outside surface 121*a* of the upper core 121 and the portion of the lower delivery belt 72 positioned on the outside surface 122*a* of the lower core 122 are the portions of the delivery member installed to the core assembly such that at least the portions can be exposed from the outer peripheral surface of the core assembly on which the strips are wound. As the delivery belts 71 and 72 receive power to rotate, the exposed portions of the delivery belts 71 and 72 move toward the free end of the core assembly 120. The delivery belts 71 and 72 are continuously brought into contact with the inner peripheral surface of the polygonal paper tube 200 which is formed by helically winding a plurality of the paper strips on the outer peripheral surface of the core assembly 120, and cause the paper tube 200 to be delivered toward the free end of the core assembly 120.

Also, the apparatus for manufacturing a paper tube of the present embodiment makes it possible to control the gap between the upper core 121 and the lower core 122 fixed to the coupling member 52, whereby it is possible to change the width of a paper tube to be manufactured. That is, the coupling member 52 is equipped with linear guides 153, and the upper core 121 and the lower core 122 are respectively fixed to a pair of brackets 154 and 155 movably installed to the linear guides 153.

In addition, the apparatus for manufacturing a paper tube of the present embodiment further comprises a paper tube cutting means 130 for cutting the paper tube continuously discharged toward the free end of the core assembly 120 by an appropriate length. The paper tube cutting means 130 comprises a base 131 installed to the frame 10 to be movable in the longitudinal direction of the core assembly 120, and a cutter 132 installed to the base to be movable in the direction perpendicular to the longitudinal direction of the core assembly 120. The frame 10 is mounted with a motor 146 for providing the power for moving the base 131 and a pair of linear guides 144 for guiding the movement of the base 131. When the paper tube is cut, the base 131 is caused to move at the same velocity as the discharge velocity of the paper tube by a ball screw 145 installed on a shaft of the motor 146.

Further, the base 131 is mounted with a bed 133 for moving the cutter 132 in the direction perpendicular to the discharge direction of the paper tube, and the bed 133 is mounted with vertical delivery guides 140. A delivery plate 139 is mounted to the guides and thus is installed on an upper portion of the bed 133, and the cutter 132 and a motor 134 for driving the cutter 132 are installed to an upper portion of the delivery plate 139. The cutter 132 and the motor 134 are installed to the delivery plate 139, which is provided with linear guides to minutely move in the discharge direction of the paper tube when the paper tube is cut. As shown in the figure, it is preferred that a rotating circular cutter or a saw blade be used as the cutter 132.

In addition, the paper tube cutting means 130 is supported to the base 131, is installed so as to rotate at the same angular velocity as the core assembly 120, and further includes a fourth hollow rotational shaft 146 formed with a through-hole 146*a* through which the paper tube discharged toward the free end of the core assembly 120 passes. Although not shown, the fourth rotational shaft is equipped with a device for gripping the paper tube the end of which is pushed by the cutter when the discharged paper tube is cut.

Since the operation of the apparatus for manufacturing a paper tube of the present embodiment is identical to that of the operation of the apparatus for manufacturing a paper tube of an embodiment shown in FIG. 1 except that the paper tube cutting means 130 cuts the paper tube discharged toward the free end of the core assembly 120 in the present embodiment, the description of the operation of the present embodiment will be omitted.

Figure 15:
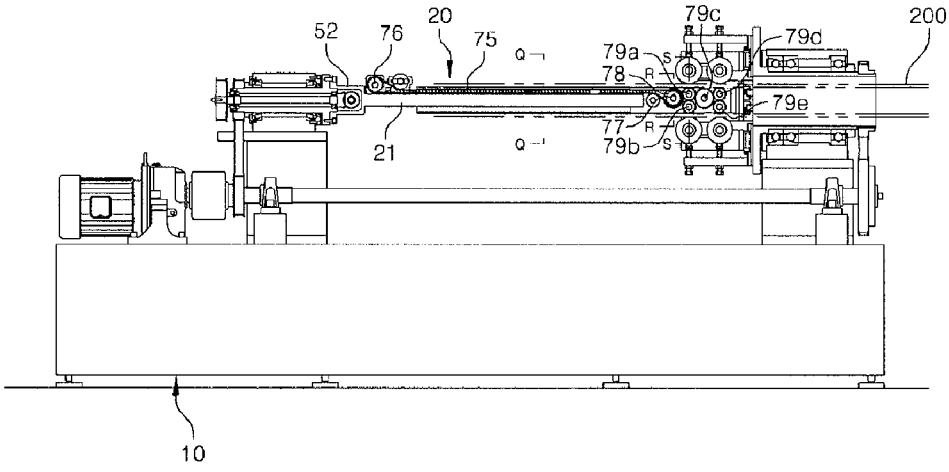
FIG. 15 is a schematic view illustrating an apparatus for manufacturing a paper tube having a polygonal cross section according to a further embodiment of the present invention.
Figure 16:
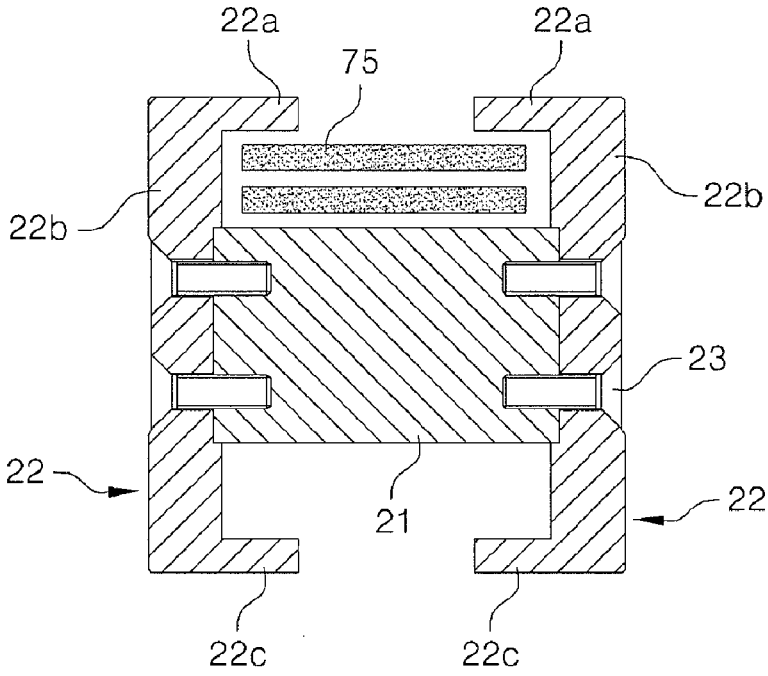
FIG. 16 is a sectional view taken along line Q-Q of FIG. 15.
Figure 17:
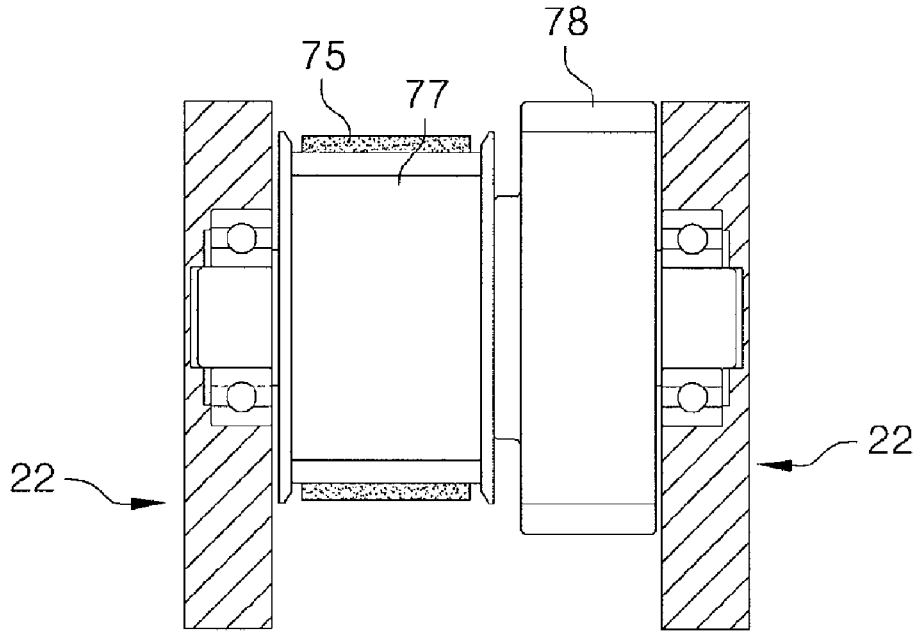
FIG. 17 is a sectional view taken along line R-R of FIG. 15.
Figure 18:
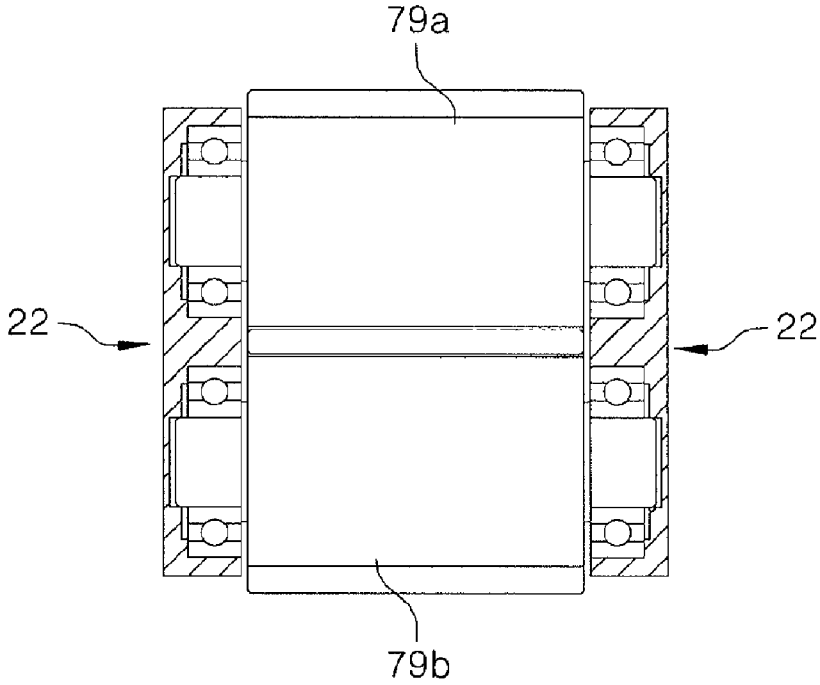
FIG. 18 is a sectional view taken along line S-S of FIG. 15.

FIG. 15 is a schematic view illustrating an apparatus for manufacturing a paper tube having a polygonal cross section according to a further embodiment of the present invention, FIG. 16 is a sectional view taken along line Q-Q of FIG. 15, FIG. 17 is a sectional view taken along line R-R of FIG. 15, and FIG. 18 is a sectional view taken along line S-S of FIG. 15.

The apparatus for manufacturing a paper tube according to one embodiment of the present invention is different from the apparatus for manufacturing a paper tube shown in FIG. 1 in that delivery gears 79*a*, 79*b*, 79*d* and 79*e* installed a core assembly 20 are used as the delivery member for a paper tube. The core assembly 20 of the present embodiment includes an elongate quadrangular rod core 21 with an end fixed to a coupling member 52 and a pair of elongate delivery guide members 22 fixed to both opposite side surfaces of the quadrangular rod core 21. Each of the delivery guide members 22 includes a base portion 22*b* wider than the quadrangular rod core 21 and fixed to each of both the side surfaces of the quadrangular rod core 21 and upper and lower guide wing portions 22*a* and 22*c* protruding in parallel from both widthwise ends of each base portion 22*b* toward the opposite one of the base portions 22*b* spaced apart from each other and extending by a predetermined length in a longitudinal direction. A pair of the delivery gears 79*a* and 79*b* is rotatably installed to the free ends of the delivery guide members 22 where the guide wing portions 22*a* and 22*c* are removed so that addendum circles of the gears protrude upward from the delivery guide members 22. A gear 79*c* is a transmission gear for transmitting power to a pair of the delivery gears 79*d* and 79*e* adjacent thereto.

A power transmitting means for transmitting the rotational power of the third rotational shaft 62 shown in FIG. 9 to the delivery gears 79*a* and 79*b* includes a belt driving shaft 76 rotatably installed to the fixed end of the quadrangular rod core 21, a gear, not shown, for transmitting the rotational power of the third rotational shaft 62 to the belt driving shaft 76, a belt driven shaft 77 installed to the free end of the core assembly 20, a belt 75 for connecting the belt driving shaft 76 and the belt driven shaft 77 to each other, and a gear 78 fixed to the belt driven shaft 77 and installed to be meshed with the delivery gear 79*a*.

In the present embodiment, the addendum circle portions of the respective delivery gears 79*a*, 79*b*, 79*c* and 79*d* which protrude outward from the delivery guide members 22 are the portions of the delivery member installed to the core assembly such that at least the portions can be exposed from the outer peripheral surface of the core assembly on which the strips are wound. As the delivery gear 79*a*, 79*b*, 79*c* and 79*d* receive the power of the belt 75 to rotate, the addendum circle portions thereof which protrude outward from the delivery guide members 22 move toward the free end of the core assembly 20. The addendum circle portions are continuously brought into contact with an inner peripheral surface of the polygonal paper tube which is formed by helically winding a plurality of the paper strips on the outer peripheral surface of the core assembly 20, and cause the paper tube 200 to move toward the free end of the core assembly 20.

Figure 19:
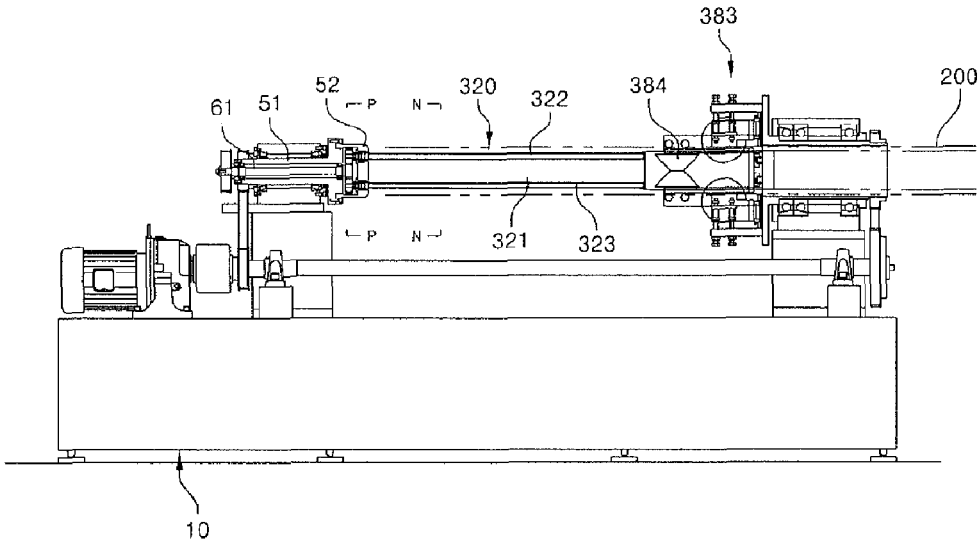
FIG. 19 is a schematic view illustrating an apparatus for manufacturing a paper tube having a polygonal cross section according to an embodiment of the present invention.
Figure 20:
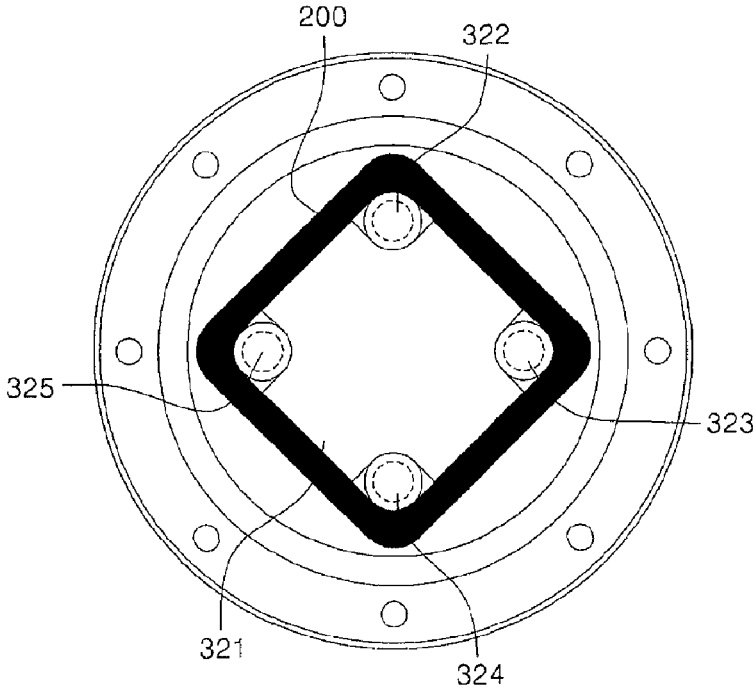
FIG. 20 is a sectional view taken along line N-N of FIG. 19.
Figure 21:
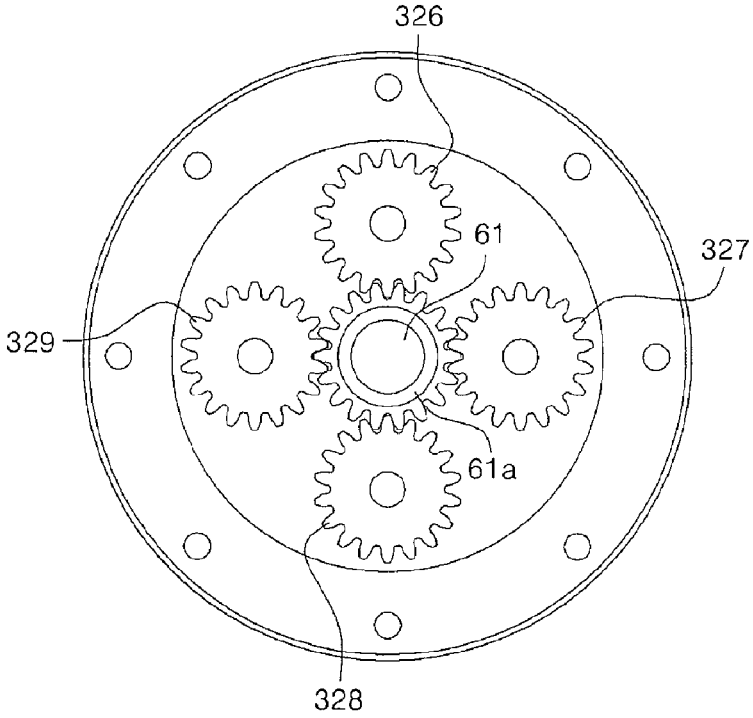
FIG. 21 is a sectional view taken along line P-P of FIG. 19.

FIG. 19 is a schematic view illustrating an apparatus for manufacturing a paper tube having a polygonal cross section according to an embodiment of the present invention, FIG. 20 is a sectional view taken along line N-N of FIG. 19, FIG. 21 is a sectional view taken along line P-P of FIG. 19.

The apparatus for manufacturing a paper tube of the present embodiment is different from the apparatus for manufacturing a paper tube shown in FIG. 1 in that delivery screws installed to the core assembly 20 are used as the delivery member of the paper tube in the present embodiment.

Referring to FIGS. 19 and 20, a core assembly 320 according to this embodiment includes an elongate quadrangular rod core 321 having an end fixed to the coupling member 52 and the other free end. Four corner portions of the quadrangular rod core 321 are removed by a predetermined length along its longitudinal direction from the portion where the quadrangular rod core 321 is connected to the coupling member 52. In addition, the delivery screws 322, 323, 324 and 325 are respectively inserted into the four removed corner portions of the quadrangular rod core 321 and are installed such that portions of outer peripheral surfaces of the delivery screws are exposed to the outside. One ends of the delivery screws are rotatably installed to the coupling member 52 and the other ends thereof are rotatably installed to the non-removed portions of the quadrangular rod core 321. Although not shown, the outer peripheral surfaces of the respective delivery screws 322, 323, 324 and 325 are formed with threads. Referring to FIG. 21, driven gears 326, 327, 328 and 329 are fixed to the ends of the delivery screws 322, 323, 324 and 325 which are fixed to the coupling member 52, respectively. A driving gear 61*a* fixed to an end of the second rotational shaft 61 is installed at the center of the driven gears to be meshed therewith. A pressing means 383 of the apparatus for manufacturing a paper tube of the present embodiment is also different from the pressing means 83 of an embodiment shown in FIG. 1 in that the pressing means 383 of the present embodiment uses tapered rollers 384 for pressing corner portions of the paper tube.

In the present embodiment, the threads which are formed on the outer peripheral surfaces of the delivery screws 322, 323, 324 and 325 rotatably installed to the removed corner portions of the quadrangular rod core 321 and brought into contact with an inner peripheral surface of the paper tube are the portions of the delivery member installed to the core assembly such that at least the portions can be exposed from the outer peripheral surface of the core assembly on which the strips are wound. As the delivery screws 322, 323, 324 and 325 receive the power from the driving gear 61 a to rotate, the threads of the delivery screws move toward the free end of the core assembly 20. At the same time, the threads are continuously brought into contact with the inner peripheral surface of the polygonal paper tube 200, and cause the paper tube to move toward the free end of the core assembly 20.

Figure 22:
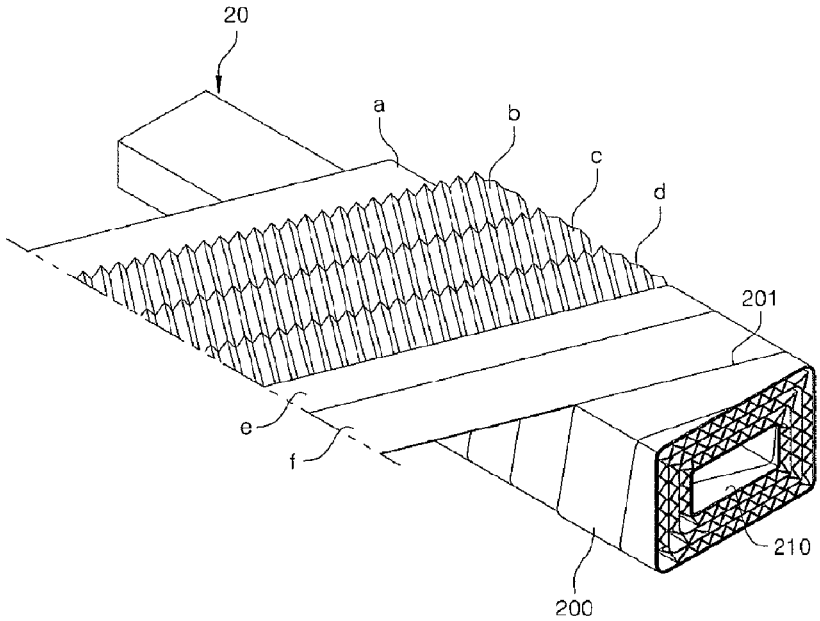
FIG. 22 is an exemplary view illustrating a state where a polygonal paper tube is manufactured using one-sided corrugated cardboard strips.

FIG. 22 is an exemplary view showing a state where a polygonal paper tube is manufactured using one-sided corrugated cardboard strips, which have corrugations parallel with the longitudinal direction of the strips. Referring to FIGS. 2 and 22, when using the method and apparatus according to an embodiment of the present invention, it is possible to manufacture a polygonal paper tube by arranging liner base papers a, e and f and one-sided corrugated cardboard b, c and d on the core assembly 20 in order shown in the figure. In the apparatus according to an embodiment of the present invention, the portion of a delivery member exposed to the outside in the core assembly moves toward the free end of the core assembly, so that it is possible to manufacture a paper tube without damaging the corrugations of the corrugated cardboard strips. Although one-sided corrugated cardboard strips are used in the present embodiment, it is not limited thereto and both-sided corrugated cardboard strips may be used. It is also possible to manufacture a paper tube with the direction of corrugated medium paper of one-sided corrugated cardboard reversed (that is, to face an inside surface of a polygonal paper tube to be formed). According to embodiments of the present invention, it is possible to manufacture a thick paper tube by discharging a plurality of paper strips helically overlapped and wound on a rotating core from the core using a delivery member which moves in the core. Also, according to embodiments of the present invention, since a thick polygonal paper tube can be manufactured, it is possible to provide a polygonal paper tube with high strength. In addition, according to embodiments of the present invention, even though a polygonal paper tube is manufactured using one-sided corrugated cardboard strips, it is possible to prevent corrugations of the corrugated cardboard from being damaged.

According to embodiments of the present invention, since a paper tube is continuously produced by helically overlapping and winding strips, the productivity of the paper tube is superior. If there is provided a polygonal paper tube, which has high strength since the paper tube is thick, it is possible to provide a paper pallet with high strength and low costs. If a paper pallet with high strength is provided, it is possible to substitute paper pallets for wood pallets used in delivery of a weight, which can reduce felling and also contributing to the environment preservation.

Embodiments of the present invention described above and shown in the figures should not be analyzed to limit the technical spirit of the present invention. The true scope of the present invention is defined only by the claims. Those skilled in the art of the present invention can modify and change the technical spirit of the present invention into various forms. Therefore, as far as the modifications and changes are apparent to those skilled in the art, the modifications and changes will belong to the true scope of the present invention.

What is claimed is:

1. An apparatus for making a tube having a polygonal cross-section with at least one sheet band, the apparatus comprising:

a shaft extending along a longitudinal axis, comprising a free end and rotatable about the longitudinal axis, the shaft being configured to rotate about the longitudinal axis to take up at least one sheet band to form a tube around the shaft, the shaft comprising a plurality of edges extending along the longitudinal axis such that the at least one band is wound around the plurality of edges to form a tube having a polygonal cross-section, the shaft comprising:

a shaft body extending along the longitudinal axis, a first belt mechanism supported by the shaft body and comprising pulleys and a first belt looped over the pulleys to form a first circulation loop of the first belt, wherein the first circulation loop comprises a first conveyor section extending along the longitudinal axis, wherein the first belt is configured to circulate along the first circulation such that a portion of the first belt passes the conveyor section, wherein the portion of the first belt is configured to frictionally engage with an inner surface of the tube and transfer the tube toward the free end during the passage of the conveyer section, a second belt mechanism supported by the shaft body and comprising pulleys and a second belt looped over the pulleys to form a second circulation loop of the second belt, wherein the second circulation loop comprises a second conveyor section extending along the longitudinal axis, wherein the second belt is configured to circulate along the second circulation loop such that a portion of the second belt passes the second conveyor section, wherein during the passage the portion of the second belt is configured to frictionally engage with an inner surface of the tube and transfer the tube toward the free end during the passage of the second conveyor section; and a drive mechanism coupled to the shaft to rotate the shaft about the longitudinal axis and circulate the first and second belts;

wherein a distance between the conveyor sections of the first and second belt mechanisms is adjustable for allowing the size of the tube's cross-section to be changed.

2. The apparatus of claim 1, wherein the shaft body comprises a first body section extending along the longitudinal axis and configured support the first belt mechanism, and a second body section extending along the longitudinal axis and configured to support the second belt mechanism, wherein the first body section is configured to move relative to the second body section in a direction perpendicular to the longitudinal axis so as to adjust the distance.

3. The apparatus of claim 2, further comprising a linear movement mechanism configured to move the first body section relative to the second body section.

4. The apparatus of claim 2, wherein the shaft body comprises a spacer interposed between the first and second body sections.

5. The apparatus of claim 1, wherein the feed direction of the at least one sheet band is oblique with respect to the longitudinal axis such that the at least one sheet band can be spirally wound around the shaft.

6. The apparatus of claim 1, further comprising a cutter movable along the longitudinal axis along the tube's movement away from the shaft, and further movable in a direction perpendicular to the longitudinal axis to cut the tube while moving along the longitudinal axis.

7. The apparatus of claim 6, wherein the cutter's movement along the longitudinal axis has a speed equal to that of the tube's movement along the longitudinal axis.

8. The apparatus of claim 6, further comprising a tube holder movable along the longitudinal axis along the tube's movement away from the shaft, rotatable about the longitudinal axis and configured to hold the tube during the cutting of the tube.

9. The apparatus of claim 8, wherein the tube holder has a rotational speed equal to that of the tube.

10. The apparatus of claim 1, further comprising a tube presser rotatable about the longitudinal axis and configured to press an outer surface of the tube such that the tube is disposed between the presser and the first belt.

11. The apparatus of claim 10, further comprising an additional tube presser rotatable about the longitudinal axis and configured to press an outer surface of the tube such that the tube is disposed between the additional presser and the second belt.

12. The apparatus of claim 10, wherein the tube presser has a rotational speed equal to that of the tube.

13. The apparatus of claim 10, wherein the tube presser comprises a belt that is configured to frictionally engage with the outer surface and transfer the tube toward the free end.

14. The Apparatus of claim 1, further comprising a sheet band supplier configured to provide the at least one sheet band.

15. A method of making a hollow tube, the method comprising:

providing the apparatus of claim 1, rotating the shaft about the longitudinal axis to spirally wind at least one sheet band around the shaft so as to form a tube around the shaft, wherein the tube comprises an inner surface;

frictionally engaging the inner surface with a portion of the first belt and a portion of the second belt; and circulating the first and second belts so as to transfer the tube in a transfer direction along the longitudinal axis.

16. The method of claim 15, further comprising:

adjusting a distance between the conveyor section of the first belt mechanism and the conveyor section of the second belt mechanism;

subsequently to adjusting, rotating the shaft about the longitudinal axis to spirally wind at least one sheet band around the shaft so as to form a secondary tube of the sheet around the shaft, wherein the cross-section of the secondary tube has a size different from that of the cross-section of the tube.

17. The method of claim 15, wherein frictionally engaging and transferring occurs substantially simultaneously.

18. The method of claim 15, wherein frictionally engaging and transferring occurs substantially continuously.

19. The method of claim 15, wherein the at least one sheet band comprises a plurality of sheet bands to form the tube of a plurality of sheet layers, wherein the tube is continuously moving generally along the longitudinal axis such that the plurality of bands are wound around a substantially identical portion of the shaft.

20. The method of claim 19, wherein the plurality of bands comprises at least one corrugated paper band so as to form at least one corrugated paper layer.

* * * * *